United States Patent [19]

Brooks et al.

[11] 4,147,124

[45] Apr. 3, 1979

[54] APPARATUS FOR LAUNCHING STORES FROM A SUBMERGED VEHICLE

[75] Inventors: John D. Brooks, San Diego; Harry W. Humason, Encinitas; Frank E. Gordon, San Diego, all of Calif.

[73] Assignee: The United States of America as represented by the Secretary of the Navy, Washington, D.C.

[21] Appl. No.: 836,324

[22] Filed: Sep. 26, 1977

[51] Int. Cl.[2] ..... B63G 8/30

[52] U.S. Cl. ..... 114/321; 89/1.81

[58] Field of Search ..... 114/16 R, 16.5, 16.7, 114/166, 140, 20 R, 312, 321; 89/1.809, 1.81, 5, 38, 39; 187/8.71; 244/3.24; 102/2, 7

[56] References Cited

U.S. PATENT DOCUMENTS

| | | | |
|---|---|---|---|
| 1,036,150 | 8/1912 | Reÿngoudt | 114/16.7 |
| 1,926,229 | 9/1933 | Deschenes | 114/16.7 |
| 2,330,477 | 9/1943 | Donnelly | 114/16.7 |
| 2,393,604 | 1/1946 | Berger | 102/2 |
| 3,137,203 | 6/1964 | Brown | 89/5 X |
| 3,282,566 | 11/1966 | Clarke | 187/8.71 |
| 3,848,558 | 11/1974 | Henry | 114/16 R |

*Primary Examiner*—George E. A. Halvosa
*Assistant Examiner*—Sherman D. Basinger
*Attorney, Agent, or Firm*—Richard S. Sciascia; Ervin F. Johnston; James O. Skarsten

[57] ABSTRACT

An apparatus for launching stores from a recess of a vehicle submerged in a marine environment includes a capsule having an elongated body of rectangular cross section for enclosing the stores. A structure for providing hydrodynamic stability to the capsule is joined thereto, the capsule and stabilizing structure together being receivable into the recess. The apparatus is further provided with a first hatch for sealing the recess from the marine environment when the apparatus is received thereinto.

10 Claims, 4 Drawing Figures

APPARATUS FOR LAUNCHING STORES FROM A SUBMERGED VEHICLE

STATEMENT OF GOVERNMENT INTEREST

The invention described herein may be manufactured and used by or for the government of the United States of America for governmental purposes without the payment of any royalties thereon or therefor.

BACKGROUND OF THE INVENTION

The present invention pertains to apparatus for carrying stores aboard and for launching stores from a submerged vehicle. More particularly, the invention pertains to such apparatus wherein the stores are contained in a capsule of selected shape which is releasably attached to the vehicle outside the pressure hull thereof.

Certain weapons, such as the harpoon missile, are carried aboard submarines by enclosing them in buoyant capsules, which in turn are carried in recesses in a hydrodynamically streamlined pod or fairing, the fairing being mounted upon the pressure hull of the submarine. To launch a weapon from a submarine while submerged, a hatch sealing the recess in which the weapon is carried is opened, whereupon the capsule enclosing the weapon is released into the surrounding water and propelled to the surface by its own buoyancy. In the case of the harpoon missile, the missile is fired from the buoyant capsule when the capsule reaches the surface or a specified distance therefrom. It may be noted that other stores, such as communications equipment or a decoy target, may also be launched from a submerged submarine by means of such capsules.

At present, most buoyant capsules are of circular cross-section and are received into fairing recesses which are covered or sealed by movable doors or hatched of curved shape. Generally, such hatches are fairly heavy and require heavy foundations, which serves to increase the top-side weight of a submarine employing them. Substantial power may be required to open the hatches in order to launch or release a capsule, and if the hatches are opened into the slip-stream of the submarine, they increase drag thereupon. The hatches must be pivoted about hinges, and may require complicated latching mechanisms, all of which is subject to wear through repeated use.

In addition, some designs for capsules of circular cross-section have been found to be of insufficient buoyancy and hydrodynamic stability for certain applications.

SUMMARY OF THE INVENTION

The present invention is intended to overcome the aforementioned disadvantages by providing apparatus for launching stores from a recess within a submerged platform, such as a submarine. The apparatus comprises a capsule having a rectangular cross section for enclosing the stores, and means for hydrodynamically stabilizing the capsule joined thereto, the capsule and stabilizing means being receivable into the recess. For a fairing recess of given volume, it is believed that a capsule of rectangular cross-section may provide greater buoyancy than certain conventional circular designs, and a stabilizing means as hereinafter disclosed may provide improved hydrodynamic stability.

In a preferred embodiment of the invention, a fairing having a recess is mounted on a submersible vehicle, the apparatus being receivable into the recess, and a first hatch means is joined to the capsule for closing and sealing the recess from the environment when the apparatus is received into the recess. To reduce drag upon the vehicle, the hatch means is provided with a surface which forms a portion of the exterior surface of the vehicle when the apparatus is received into the recess. The capsule is provided with a cavity for receiving the stores and with positive buoyancy, and a latch means is coupled between the apparatus and the vehicle for retaining the apparatus in the recess until an instruction to launch the stores is coupled to the latch means. Upon receiving the instruction, the latch means releases the apparatus, including the capsule, stabilizing means and hatch means and the apparatus is propelled into the environment by the buoyancy of the capsule. Since the hatch means departs from the vehicle along with the capsule and stabilizing means, hinges and foundations for the hatch are unnecessary, and the hatch means may be formed of material which is light in comparison with the material used for conventional recess doors or hatches. Consequently, an embodiment of the invention may enable a substantial reduction in top-side weight of a vehicle with which it is employed. Also, the time duration of the launching procedure is very brief, minimizing interference with the slip-stream of the vehicle.

Preferably, the stabilizing means comprises a first means for resisting vertical motion, and a second means for resisting lateral motion, about the center of balance of the apparatus when the apparatus moves through the environment. The stabilizing means is joined to an end of the capsule in spaced relation therefrom by means of a boom or other elongated member.

In a modification of the above embodiment, the apparatus further comprises a second hatch means joined to the fairing for sealing the recess when the capsule, stabilizing means, and hatch means have been released. Preferably, the second hatch means is adapted to be depressed into the recess when the apparatus is retained therein, and a means is coupled to the fairing for urging the apparatus into the environment upon the release thereof.

While it is believed that the present invention may be usefully embodied or employed as above stated, it is not intended to limit the invention thereto.

OBJECTS OF THE INVENTION

An object of the invention is to provide improved apparatus for carrying stores aboard a submersible vehicle or other platform, and for launching the stores while the vehicle is submerged.

Another object is to provide an improved and simplified apparatus for launching stores from a recess in a fairing, which is mounted upon a submerged vehicle or other platform, external to the pressure hull thereof.

Another object is to provide apparatus for launching stores from a submerged vehicle which reduces the weight of the equipment required therefor.

Another object is to reduce interference with the hydrodynamic streamlining of a submerged vehicle while stores are being launched therefrom.

Another object is to provide apparatus for launching stores from a recess in a fairing mounted upon a submerged vehicle which eliminates hinged recess doors or hatches and foundations therefor.

Another object is to provide a capsule, used for launching stores from a recess in the hull of a submerged vehicle, with improved buoyancy and hydrodynamic stability where the volume or size of the recess is limited.

These and other objects of the invention will become more readily apparent from the ensuing specification when taken with the drawings.

DESCRIPTION OF THE PREFERRED EMBODIMENT

Figure 1:
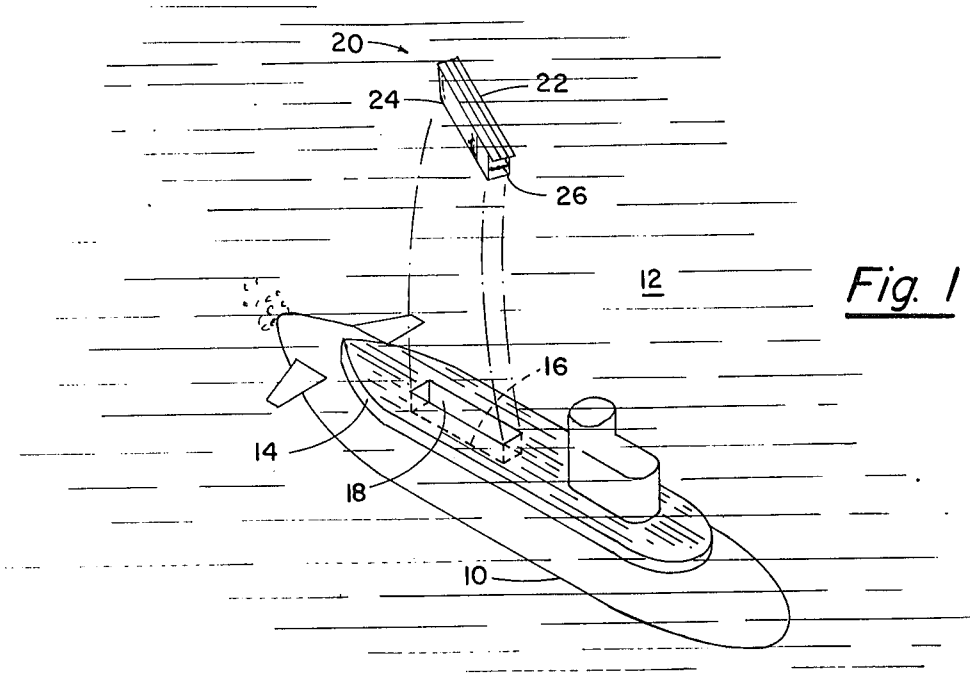
FIG. 1 is a perspective view which shows an embodiment of the invention being employed to launch stores from a submersible vehicle submerged in a marine environment.

Referring to FIG. 1, there is shown a submarine or other submersible vehicle 10 submerged in a marine environment 12, vehicle 10 including a pod or fairing 14 of hydrodynamically streamlined shape which is mounted external to the pressure hull of vehicle 10. A recess 16 in fairing 14 communicates with environment 12 through a rectangular-shaped access opening 18.

Referring further to FIG. 1, there is shown a launching assembly 20 having a hatch means 22 joined thereto. Dimensions of assembly 20 and recess 16 are respectively selected so that assembly 20 is receivable into recess 16 and may be carried therein. Similarly, dimensions of hatch means 22 and access opening 18 are respectively selected so that hatch means 22 closes and seals access opening 18 when assembly 20 is received into recess 16. Assembly 20 includes a capsule 24, which has an elongated body of rectangular cross section, and which is of sufficient size to enclose selected stores such as a weapon, decoy target or communications equipment. Consequently, the stores are carried aboard vehicle 10 whenever assembly 20 is retained in recess 16, and capsule 24 is provided with positive buoyancy so that the stores may be launched by releasing capsule 24, the buoyancy thereof propelling assembly 20 and hatch 22 away from vehicle 10 and through environment 12.

FIG. 1 also shows assembly 20 including stabilizing means 26, which is joined to an end of capsule 24 and to hatch 22 for hydrodynamically stabilizing the structure comprising assembly 20 and hatch 22 as the same moves through environment 12 subsequent to release.

It may be noted that for other applications, for example, to set out underwater mines, capsule 24 may be provided with neutral or negative buoyancy.

Figure 2:
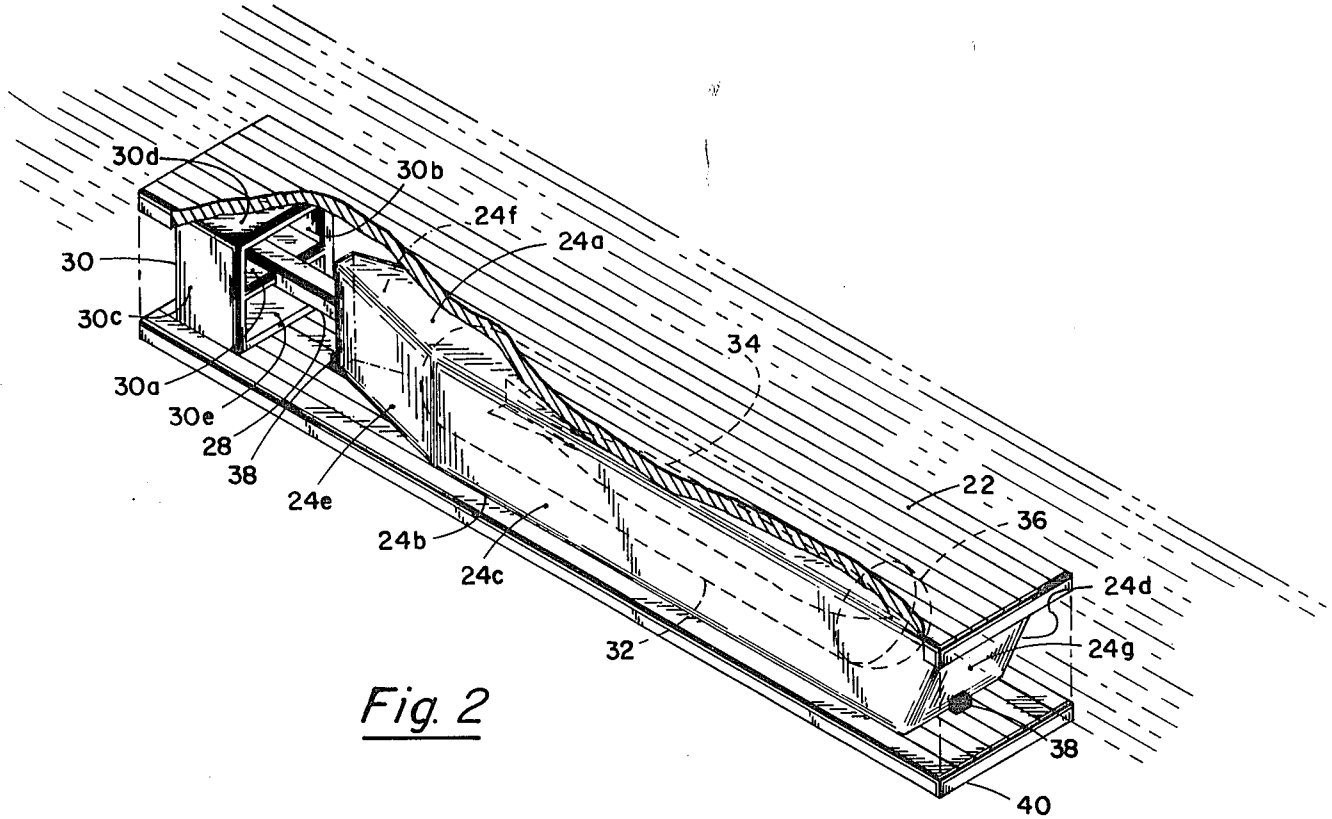
FIG. 2 is an isometric view of the embodiment of FIG. 1 in greater detail.

Referring to FIG. 2, there is shown capsule 24 having flat upper and lower surfaces **24*a* and 24*b*, respectively, flat side surfaces 24*c* and 24*d*, respectively, and flat afterbody side surfaces 24*e* and 24*f*. Surfaces 24*a* and 24*b* are perpendicularly joined to surfaces 24*c* and 24*d* and to surfaces 24*e* and 24*f* along respective adjacent edges, whereby capsule 24 has a rectangular cross section, surfaces 24*e* and 24*f* comprising respective sides of a tapering after body for capsule 24. Boom 28 comprises an elongated member connected to the after body of capsule 24 for joining capsule 24 and tail 30, wherein boom 28 and tail 30 comprise stabilizing means 26. A flat forward surface 24*g* of capsule 24 lies at a slight angle to the plane which is perpendicular to surfaces 24*a* and 24*b*. Capsule 24** is formed of a buoyant material such as syntactic foam, whereby the capsule is positively buoyant.

Pressure shell 32 comprises a conventional container of circular cross section for containing stores of the type which are commonly launched from a submerged vehicle. Shell 32 fits into a cavity in capsule 24, whereby stores contained in shell 32, such as missile 34 are enclosed within capsule 24, and the forward end 36 of shell 32 is detachable from the remainder thereof. To launch missile 34 from vehicle 10, assembly 20 is released from recess 16 and propelled toward the surface of marine environment 12, missile 34 igniting when it is at or near the surface. Thereupon, building pressure within shell 32 separates detachable end 36 therefrom, along with a forward portion of capsule 24.

Referring further to FIG. 2, there is shown tail 30 including a flat rectangular member **30*a* joined to boom 28 so that the plane of member 30*a* is parallel to the plane of surfaces 24*a* and 24*b*. Flat rectangular members 30*b* and 30*c* are perpendicularly joined to member 30*a*, along opposite edges thereof, whereby members 30*b* and 30*c* are in spaced parallel relationship with one another, and the planes thereof are parallel to the planes of surfaces 24*c* and 24*d*. Flat rectangular members 30*d* and 30*e* are perpendicularly joined to members 30*b* and 30*c* whereby members 30*a*, 30*d*, and 30*e* are in spaced parallel relationship with one another. Members 30*d* and 30*e* comprise first tail members and resist vertical motion of the structure comprising assembly 20 and hatch 22 about the center of balance thereof, as the structure moves through environment 12. Similarly, members 30*c* and 30*b* comprise second tail members and resist lateral motion of the structure about the center of balance thereof as the structure moves through environment 12**.

FIG. 2 also shows latches 38 of selected conventional design, coupling capsule 24 to bottom surface 40 of recess 16, whereby assembly 20 and hatch 22 are detachably retained within recess 16. Latches 38 may comprise, for example, electromechanical devices responsive to an instruction coupled thereto from inside submarine 10 to launch the stores enclosed in capsule 24, whereupon assembly 20 and hatch 22 are released.

Referring once more to FIG. 2, there is shown hatch 22 comprising a flat rectangular member, the lower surface thereof being joined to surface **24*a* of capsule 24 and also to the upper surface of member 30*d* of tail 30. The upper surface of hatch 22 is designed so that it forms a portion of the external surface of fairing 14, whereby the hydrodynamic streamlining of vehicle 10 is maintained when assembly 20 is received into recess 16. Hatch 22** may comprise, for example, two layers of fiberglass and a layer of syntactic foam interposed therebetween.

Figure 3B:
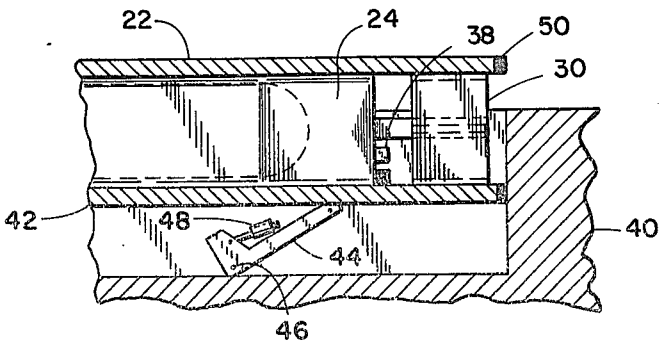
FIGS. 3A and 3B are cross-sectional views showing a modification of the embodiment of FIG. 1.
Figure 3A:
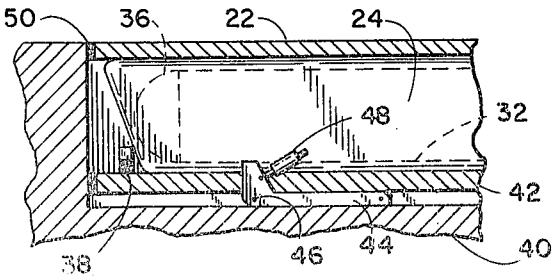

Referring to FIG. 3A, there is shown a forward portion of capsule 24 and hatch 22, retained in recess 16 as aforementioned, wherein latches 38 detachably join assembly 20 to a second hatch means 42. Second hatch means 42 comprises a flat rectangular member, and dimensions of second hatch 42 and acess opening 18 are respectively selected so that second hatch means 42 closes and seals access opening 18 when assembly 20 and hatch 22 have been released. Second hatch 42 is coupled to vehicle 10 by means of one or more arms 44, each of which is pivotable about a point 46 on vehicle 10, allowing second hatch 42 to be depressed into recess 16. A pivoting means 48, for example, a hydraulic piston, is coupled to each arm 44 to pivot the arm about point 46 as the stores are being launched from vehicle 10, urging hatch 42 toward access opening 18.

Referring to FIG. 3B, there is shown second hatch 42 in proximity to access opening 18, in response to movement of arms 44 by pivoting means 48. Latches 38 release assembly 20 when second hatch 42 has closed or is about to close access opening 18, whereby assembly 20 is prevented from moving laterally within recess 16 as it is being launched.

Referring further to FIGS. 3A and 3B, there is shown a gasket 50 positioned around the edge of access opening 18 for enabling both hatch 22 and hatch 42 to seal recess 16.

It may be noted that in some embodiments of the invention, the movement of second hatch 42 by pivoting means 46 may be used to assist the launching of assembly 20 and hatch 22 into enrivonment 12.

Obviously, many other modifications and variations of the present invention are possible in the light of the above teachings, and, it is therefore understood that the invention may be practiced otherwise than as specifically described.

What is claimed is:

1. Apparatus for moving stores launched from a hydrodynamically streamlined platform submerged in an underwater environment through a hydrodynamically stable path in said underwater environment, said apparatus comprising:

buoyancy means formed of selected buoyant material for providing specified buoyancy to a store container assembly which includes said stores and said buoyancy means, said store container assembly being launched from said platform, said buoyancy means being provided with a cavity of specified dimensions, said buoyancy means having a rectangular cross section, said buoyancy means having a plurality of flat external surfaces which are exposed to the ambient pressure of said underwater environment when said store container assembly has been launched from said platform into said underwater environment;

pressure resistance means having a circular cross section and contained within said cavity for resisting the ambient pressure of said underwater environment on said external surfaces of said buoyancy means, said pressure resistance means enclosing said stores for protecting said stores from the ambient pressure of said underwater environment when said store container assembly has been launched into said underwater environment, said pressure resistance means comprising a part of said store container assembly;

hydrodynamic stabilization means joined to said buoyancy means for resisting vertical motion and lateral motion about the center of balance of said store container assembly when said store container assembly has been launched into said underwater environment, said hydrodynamic stabilization means comprising a part of said store container assembly; and means for maintaining the hydrodynamic streamlining of said platform comprising a first means for maintaining the hydrodynamic streamlining of said platform before said store container assembly has been launched into said underwater environment, and further comprising a second means for maintaining the hydrodynamic streamlining of said platform after said store container assembly has been launched into said underwater environment, said first means being launched into said underwater environment when said store container assembly is launched.

2. The apparatus of claim 1 wherein said submerged hydrodynamically streamlined platform comprises a submerged hydrodynamically streamlined vehicle moving through said underwater environment, said stores comprise a missile which is launchable from a hydrodynamically stabilized container which has been projected through said underwater environment from said moving vehicle, and wherein said means for maintaining the hydrodynamic streamlining of said moving vehicle comprises:

fairing means joined to said moving vehicle outside of the pressure hull of said moving vehicle, said fairing means being provided with a hydrodynamically streamlined external surface, said fairing means being further provided with a recess which is dimensioned to receive said buoyancy means and said hydrodynamic stabilization means;

said first means for maintaining the hydrodynamic streamlining of said moving vehicle comprises a first hatch means having a flat surface which forms an integral part of said external surface of said fairing means before said store container assembly is launched into said underwater environment, said first hatch means being joined to said buoyancy means and comprising a part of said store container assembly; and said second means for maintaining the hydrodynamic streamlining of said moving vehicle comprises a second hatch means having a flat surface which forms an integral part of the external surface of said fairing means after said store container assembly has been launched into said underwater environment.

3. The apparatus of claim 2 wherein:

said recess communicates with said underwater environment through an access opening, said first hatch means being adapted to close and seal said access opening before said store container assembly is launched into said underwater environment, said second hatch means being adapted to close and seal said access opening after the said store container assembly is launched into said underwater environment.

4. The apparatus of claim 2 wherein said store container assembly moves through said underwater environment after launching from said moving vehicle, and wherein:

said hydrodynamic stabilization means comprises a first stabilization means for resisting vertical motion, and a second stabilization means for resisting lateral motion, about the center of balance of said store container assembly when said store container assembly moves through said underwater environment.

5. The apparatus of claim 4 wherein:

said first stabilization means comprises a plurality of flat rectangular first tail members, said first tail members being joined to said buoyancy means in spaced parallel relationship with one another, and said second stabilization means comprises a plurality of flat rectangular second tail members, said second tail members also being joined to said buoyancy means in spaced parallel relationship with one another, each of said second tail members being perpendicularly joined to each of said first tail members.

6. The apparatus of claim 4 wherein:

said hydrodynamic stabilization means further comprises an elongated member for maintaining said first stabilization means and said second stabilization means in spaced relationship with said buoyancy means.

7. The apparatus of claim 2 wherein:

said fairing means includes means for retaining said store container assembly in said recess until a selected point in time.

8. The apparatus of claim 7 wherein:

said second hatch means is adapted to be depressed into said recess when said buoyancy means and said hydrodynamic stabilization means are received into said recess.

9. The apparatus of claim 7 wherein:

said fairing means includes means for urging said store container assembly into said underwater environment at said selected point in time.

10. The apparatus of claim 1 wherein:

said buoyancy means is formed of syntactic foam.

* * * * *